United States Patent [19]

Amick

[11] Patent Number: 4,920,670

[45] Date of Patent: May 1, 1990

[54] FISH TAG

[75] Inventor: Russell D. Amick, Seattle, Wash.

[73] Assignee: Floy Tag & Mfg., Inc., Seattle, Wash.

[21] Appl. No.: 288,613

[22] Filed: Dec. 21, 1988

[51] Int. Cl.[5] ..... G09F 3/00

[52] U.S. Cl. ..... 40/300; 119/3; 40/668

[58] Field of Search ..... 128/330, DIG. 18, 898; 40/300, 668; 119/3; 24/711.1, 72.7

[56] References Cited

U.S. PATENT DOCUMENTS 2,581,561 1/1952 Shaw ..... 128/DIG. 18

*Primary Examiner*—Michael H. Thaler

*Attorney, Agent, or Firm*—Christensen, O'Connor, Johnson & Kindness

[57] ABSTRACT

A fish tag includes a monofilament having a retention member on one end and a flexible indicia bearing tube positioned about the monofilament. The second end of the monofilament extends beyond the end of the tube. A second monofilament having an enlarged end is also inserted into the tube. The enlarged end is positioned adjacent the second end of the first monofilament. The monofilaments and the tube are adhesively secured to each other. In addition, the two ends of the monofilament are secured to each other by a heat shrinkable tube that is placed about the monofilament ends and then shrunk to secure them together.

3 Claims, 1 Drawing Sheet

FISH TAG

BACKGROUND OF THE INVENTION

The present invention relates to fish tags and, more particularly, to a novel method and apparatus for securing a flexible, indicia bearing tube to a monofilament retention member.

Fish tags employed by biologists and other researchers to study the habits, life cycles, and migration routes of various species of fish. Many of the tags employ a retention number and a tubular member having alphanumeric indicia printed thereon so that when a taggered fish is recovered, the location and time of application of the tag can be ascertained. A typical fish tag constructed in accordance with the prior art is shown in FIG. 1 of the attached drawings. Referring to FIG. 1, the prior fish tag is composed of a length of monofilament line 10 having a transverse bar 12 integrally molded therewith. A length of tubing 14 is positioned about the monofilament 10 such that the free ends of the monofilament and tube are adjacent each other. A second length of filament 16 is then inserted into the free end of the tube adjacent the free end of first monofilament 10. The second monofilament 16 has an enlarged end 18 that is larger than the channel within the tube 14 so that the tube cannot pass over the enlarged end 18. In accordance with prior art techniques, a quick setting glue, such as a cyanoacrylate type adhesive, is inserted into the tube 14, securing the tube and the two monofilaments 10 and 16 to each other. Some users of the tags are of the opinion that the adhesives employed to secure the monofilaments to the tube may deteriorate over time, especially in warm, salt water environments. While this degradation has not been conclusively documented, it is desirable to possess a fish tag construction that will overcome any potential problem associated with adhesives.

SUMMARY OF THE INVENTION

The present invention provides a fish tag in which the flexible tube will remain affixed to the retention member even though the adhesive may degrade. A fish tag constructed in accordance with the present invention includes a flexible tube having a longitudinal channel, and a first monofilament extending through the channel and extending beyond both ends of the tube. The first end of the monofilament carries a tag retention means for securing the tag to a fish. The second end of the monofilament terminates outside but adjacent the end of the tube. A heat shrinkable member is shrinkably secured to the second end to prevent the tube from separating from the monofilament. It is preferred to also employ a second monofilament that extends part way into the channel inwardly from the second end of the first monofilament. The second monofilament has a second enlarged end terminating adjacent the second end of the first monofilament. Preferably, the heat shrinkable member shrinkably secures the second ends of both monofilaments to each other. In the preferred embodiment, the first and second monofilaments are also adhesively bonded to each other and to the tube with a quick setting adhesive.

BRIEF DESCRIPTION OF THE DRAWINGS

A better understanding of the present invention can be derived by reviewing the ensuing drawings in conjunction with the accompanying specification wherein.

DETAILED DESCRIPTION OF THE INVENTION

Figure 1:
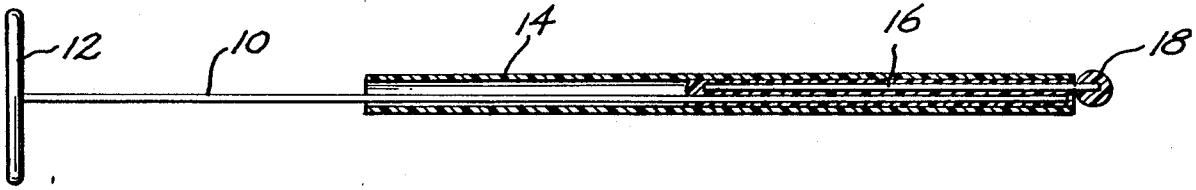
Fig. 1. (PRIOR ART)
FIG. 1 is a longitudinal sectional view of a fish tag constructed in accordance with prior art techniques.
Figure 2:
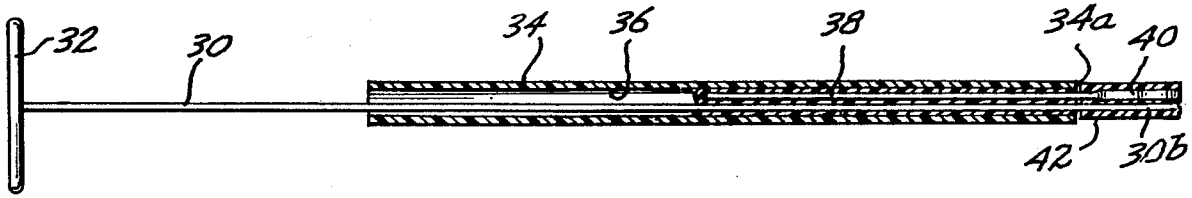
FIG. 2 is a fish tag constructed in accordance with the present invention.
Figure 3:
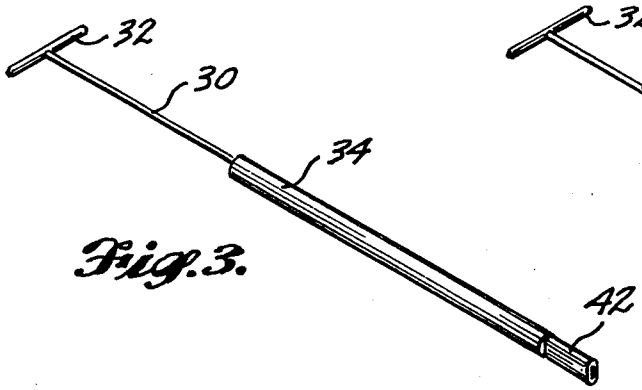
FIG. 3 is an isometric view of the assembled fish tag constructed in accordance with the present invention.

Referring first to FIGS. 2 and 3, a fish tag constructed in accordance with the present invention includes a first monofilament 30. A tag retention bar 32 is integrally molded in a transverse orientation to the first end of the monofilament 30. A flexible tube composed of a vinyl derivative or other flexible, nontoxic, nonbiodegradable material carries the alphanumeric indicia used by biologists to record and trace information about fish to which the tag is applied. The monofilament 30 extends all the way through the interior channel 36 of the tube 34. The second end **30*b* of the monofilament extends beyond the outer end 34*a* of the tube 34. A second monofilament 38 has an elongated, enlarged end 40. The second monofilament 38 is also inserted in the channel 36. The enlarged end 40 is positioned adjacent the second end 30*b* of the first monofilament 30. A heat shrinkable plastic tube 42 is positioned over the enlarged end 40 and the second end 30*b* of the two monofilaments. The heat shrinkable tube 42 is heated and shrunk so as to secure the two monofilament ends to each other. In addition, the interstices between the second monofilament 38, the interior wall of the channel 36, and the first monofilament 30** is filled with a suitable adhesive that is cured to secure these members together. Preferably, a fast setting adhesive such as one selected from the cyanoacrylate family is used.

Figure 4:
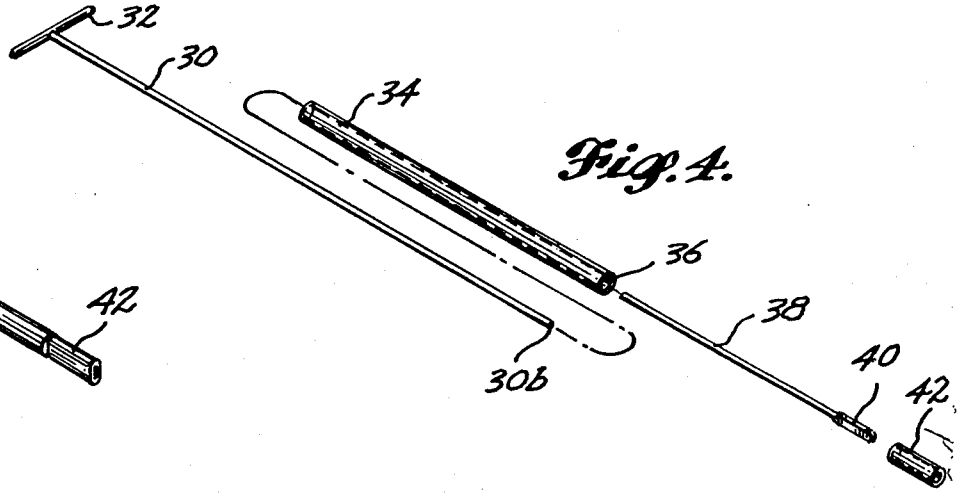
FIG. 4 is an exploded isometric view of the fish tag constructed in accordance with the present invention.

Referring to FIG. 4, the fish tag is constructed by first slipping the tube 34 over the first monofilament 30 so that the second end of the monofilament **30*b* extends through and out the end of the tube 34. The second monofilament 38 is inserted in the tube sufficiently far so that the enlarged end 40 is positioned and adjacent the second end 30*b* of the first monofilament. Thereafter adhesive is inserted into the channel 36 adjacent the two monofilaments and is cured. Thereafter the heat shrinkable tube 42 is inserted over the free ends of the monofilaments and shrunk into place. In this manner the indicia carrying tube 34 is doubly secured to the first monofilament 30**.

The present invention has been described in conjunction with a preferred embodiment. One of ordinary skill in the art after reading the foregoing specification will be able to effect various alterations, and/or substitutions of equivalents, and other changes without departing from the broad concepts disclosed herein. It is therefore intended that protection granted by Letters Patent hereon be limited only by the definition contained in the appended claims and equivalents thereof.

The embodiments of the invention in which an exclusive property or privilege is claimed are defined as follows:

1. A fish tag comprising:

a flexible tube having a longitudinal channel, a first end and a second end, a first monofilament extending through said channel from said first end through and beyond said second end of said tube, the first end of the first monofilament carrying a tag retention means for securing the tag to a fish, the second end of the first monofilament terminating outside and adjacent the second end of the tube, a second monofilament having a first end extending part way into said channel inwardly from the second end of the flexible tube and further having a second end terminating adjacent the second end of said first monofilament, and a heat shrinkable member shrinkably secured to the second end of the first monofilament and the second end of the second monofilament to prevent the tube from separating from the monofilaments.

2. The fish tag of claim 1 wherein the second end of the second monofilament is enlarged.

3. The fish tag of claim 1 wherein the first and second monofilaments are adhesively secured to the interior of said tube.

* * * * *